US007703593B2

(12) United States Patent
Kim

(10) Patent No.: US 7,703,593 B2
(45) **Date of Patent: *Apr. 27, 2010**

(54) STRUCTURE FOR ADJUSTING GAP OF PAPER MONEY DISCRIMINATING APPARATUS

(75) Inventor: Jun Young Kim, Anyang-Si (KR)

(73) Assignee: Nautilus Hyosung, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/823,920

(22) Filed: Jun. 29, 2007

(65) Prior Publication Data

US 2008/0011579 A1 Jan. 17, 2008

(30) Foreign Application Priority Data

Jun. 30, 2006 (KR) ..... 10-2006-0060657

(51) Int. Cl.
*G07D 11/00* (2006.01)
*G07D 13/00* (2006.01)

(52) U.S. Cl. ..... 194/351; 194/344

(58) Field of Classification Search ..... 194/344, 194/351; 384/247, 258, 581, 583
See application file for complete search history.

(56) References Cited

U.S. PATENT DOCUMENTS 3,227,256 A 1/1966 Schepllin
4,831,461 A * 5/1989 Ohta et al. ..... 358/296
5,462,150 A 10/1995 Chang
5,720,376 A * 2/1998 Polidoro et al. ..... 194/207
5,806,650 A 9/1998 Mennie et al.
7,178,800 B2 * 2/2007 Stauber ..... 271/189
7,422,095 B2 * 9/2008 Yoshioka ..... 194/206

FOREIGN PATENT DOCUMENTS

KR 1020020054298 7/2002
KR 20-0406406 1/2006

OTHER PUBLICATIONS

U.S. Office Action for U.S. Appl. No. 11/824,123, dated Dec. 8, 2008.

* cited by examiner

*Primary Examiner*—Patrick Mackey
*Assistant Examiner*—Mark Beauchaine
(74) *Attorney, Agent, or Firm*—Lahive & Cockfield, LLP; Thomas V. Smurzynski; Anthony A. Laurentano

(57) ABSTRACT

A structure adjusts a gap between a paper money discriminating sensor and paper money feed rollers in a paper money discriminating apparatus. The structure includes a lower body and an upper body upwardly rotating about a hinge shaft to open a conveyance path. The structure includes a paper money discriminating sensor that is provided in the upper body and discriminates whether a paper money to be conveyed along the conveyance path is counterfeit money, paper money feed rollers that are rotatably provided in the lower body facing the paper money discriminating sensor and are spaced from each other at a predetermined interval, and gap adjusters that are provided between the paper money discriminating sensor and the paper money feed rollers and adjust a gap between the paper money discriminating sensor and the paper money feed rollers.

6 Claims, 7 Drawing Sheets

STRUCTURE FOR ADJUSTING GAP OF PAPER MONEY DISCRIMINATING APPARATUS

RELATED APPLICATION

The present invention claims convention priority to, and the benefit of, Korean patent application No. 10-2006-0060657 filed on Jun. 30, 2006, the content of which is incorporated by reference.

BACKGROUND OF THE INVENTION

1. Field of the Invention

The present invention relates to a structure for a paper money discriminating apparatus that is provided, for example, in an ATM (automatic teller machine), and more particularly, to a structure for adequately adjusting a gap between a paper money discriminating sensor (which is provided to discriminate whether paper money to be conveyed along a conveyance path is counterfeit money) and paper money feed rollers in the paper money discriminating apparatus.

2. Description of the Related Art

In general, a cash dispenser unit (CDU) and a billing recycling machine (BRM) have been used as automatic teller machines that quickly and conveniently provide various financial services at anytime without consulting with a person. The CDU has been used since financial services have been computerized, and is used to withdraw only cash. The BRM has a deposit function in addition to a cash dispensing function.

FIG. 1 is a schematic view showing a structure of a conventional ATM (automatic teller machine), and FIG. 2 is a schematic side view of the structure of a conventional paper money discriminating apparatus.

An automatic teller machine includes a deposit/withdrawal unit 100 into/from which a client puts or withdraws paper moneys, a conveyance path 200 on which the paper moneys to be put into or withdrawn from the deposit/withdrawal unit 100 are transferred, a paper money discriminating unit 300 that is provided on the conveyance path 200 and discriminates paper moneys, a temporary storing unit 400 in which paper moneys deposited through the paper money discriminating unit 300 are temporarily loaded, and a plurality of recycle boxes 500 where paper moneys deposited by a client are loaded and withdrawn to be circulated.

The paper money discriminating unit 300 includes a paper money discriminating sensor 310, such as an image sensor that detects various images formed on the surface of paper money in order to discriminate the kind of paper money and a magnetic sensor that senses magnetic ingredients of the paper money.

When a gap between the sensor and the paper money is a specific distance, a sensor characteristic curve is formed so that the above-mentioned paper money discriminating sensor 310 has the best sensitivity. Further, if the gap between the sensor and the paper money is smaller or larger than the specific distance, the sensitivity of the sensor deteriorates, such that it is not possible to accurately discriminate the paper money.

For this reason, a constant gap (t) should be maintained between the paper money discriminating sensor 310 and paper money feed rollers 320 provided below the paper money discriminating sensor. Accordingly, there is a demand for a structure for adjusting the gap in order to accurately discriminate paper money.

SUMMARY OF THE INVENTION

An object of the invention is to provide a structure for adequately adjusting a gap between a paper money discriminating sensor (which is provided to discriminate whether paper money to be conveyed along a conveyance path is counterfeit money) and paper money feed rollers in a paper money discriminating apparatus.

In order to achieve the object, according to an aspect of the invention, a structure is provided for adjusting a gap between a paper money discriminating sensor and paper money feed rollers in a paper money discriminating apparatus that includes a lower body and an upper body upwardly rotating about a hinge shaft to open a conveyance path. The structure includes a paper money discriminating sensor that is provided in the upper body and discriminates whether the paper money to be conveyed along the conveyance path is counterfeit money, paper money feed rollers that are rotatably provided in the lower body facing the paper money discriminating sensor and are spaced from each other at a predetermined interval, and gap adjusters that are provided between the paper money discriminating sensor and the paper money feed rollers and adjust a gap between the paper money discriminating sensor and the paper money feed rollers.

Further, in the above-mentioned structure, bearings may be provided at both ends of a rotating shaft of the paper money feed rollers, and each of the bearings may be rotatably inserted into a hole of each of bearing seats that are formed in the lower body at both sides of the lower body.

In addition, each of the bearings may come in contact with a lower end of each gap adjuster at an upper portion thereof. Further, each of the bearings may come in contact with a supporting spring at a lower portion thereof, so that an elastic force is applied to the bearing.

Furthermore, in the above-mentioned structure, the gap adjusters may each have a thread at upper portions thereof, and be fastened into threaded holes of supporting brackets that are provided in the upper body at predetermined positions.

In the above-mentioned structure, the paper money feed rollers may be connected to a belt that rotates using power transmitted from a motor, and rotates at a predetermined speed in a direction where the paper money is conveyed.

DESCRIPTION OF THE PREFERRED EMBODIMENTS

A structure according to an exemplary embodiment of the invention and the operation thereof will be described in detail below with reference to accompanying drawings.

Figure 1:
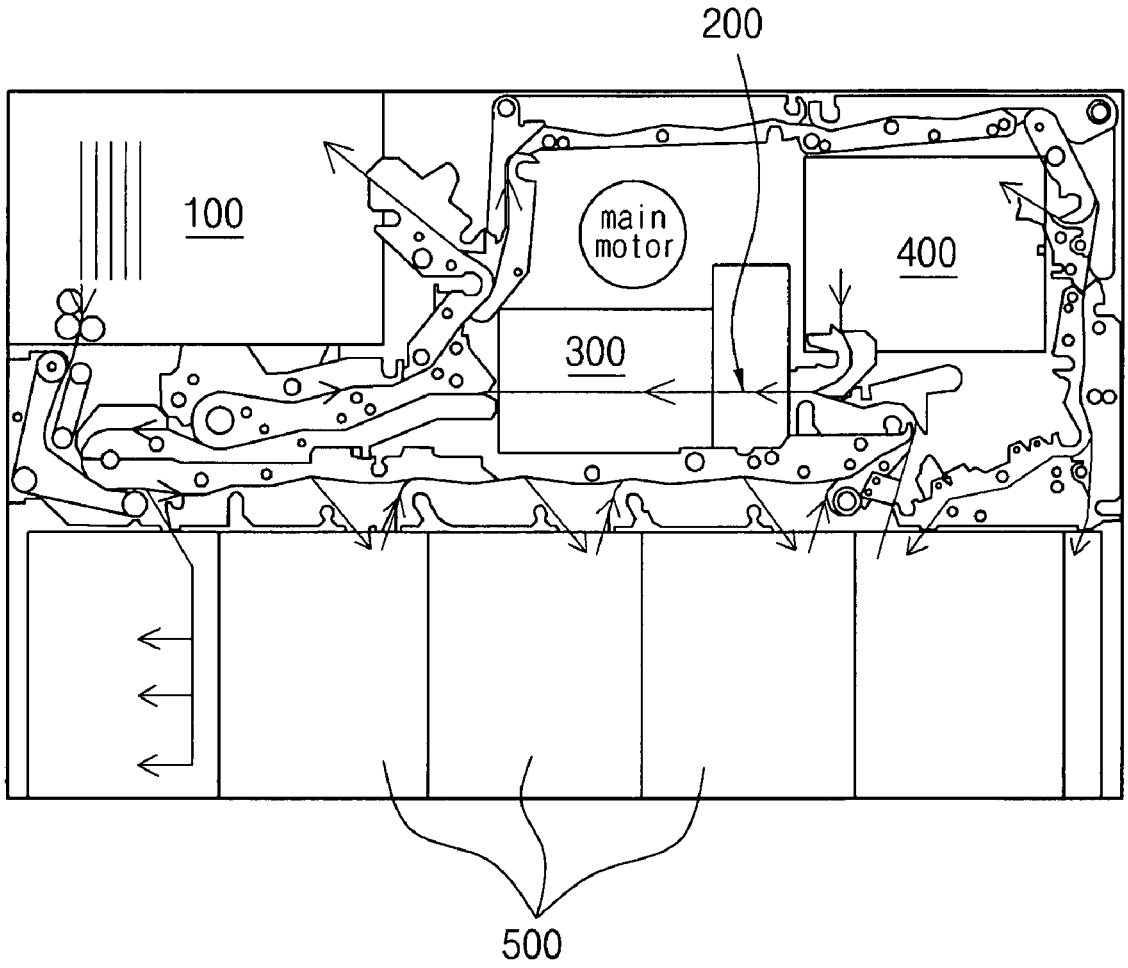
FIG. 1 is a schematic view showing a structure of a conventional ATM (automatic teller machine)
Figure 2:
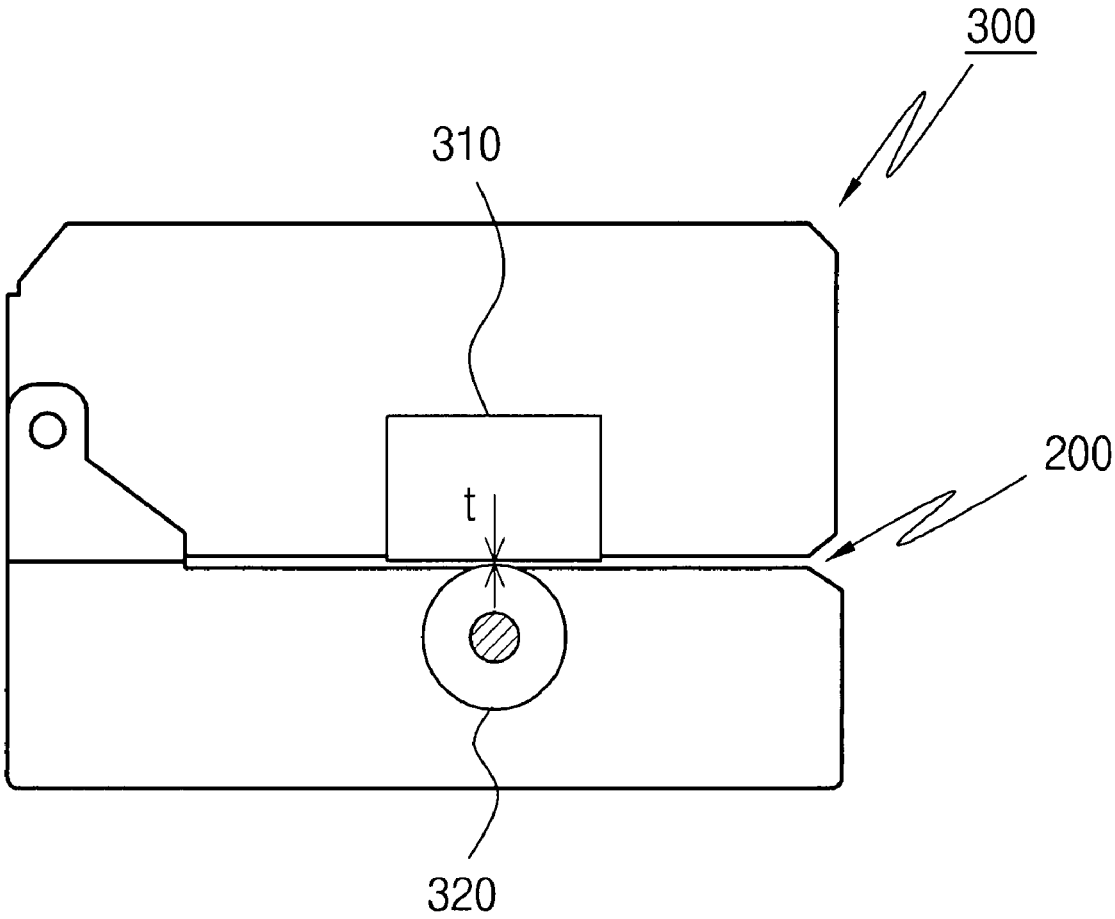
FIG. 2 is a schematic side view of a structure of a conventional paper money discriminating apparatus.
Figure 3:
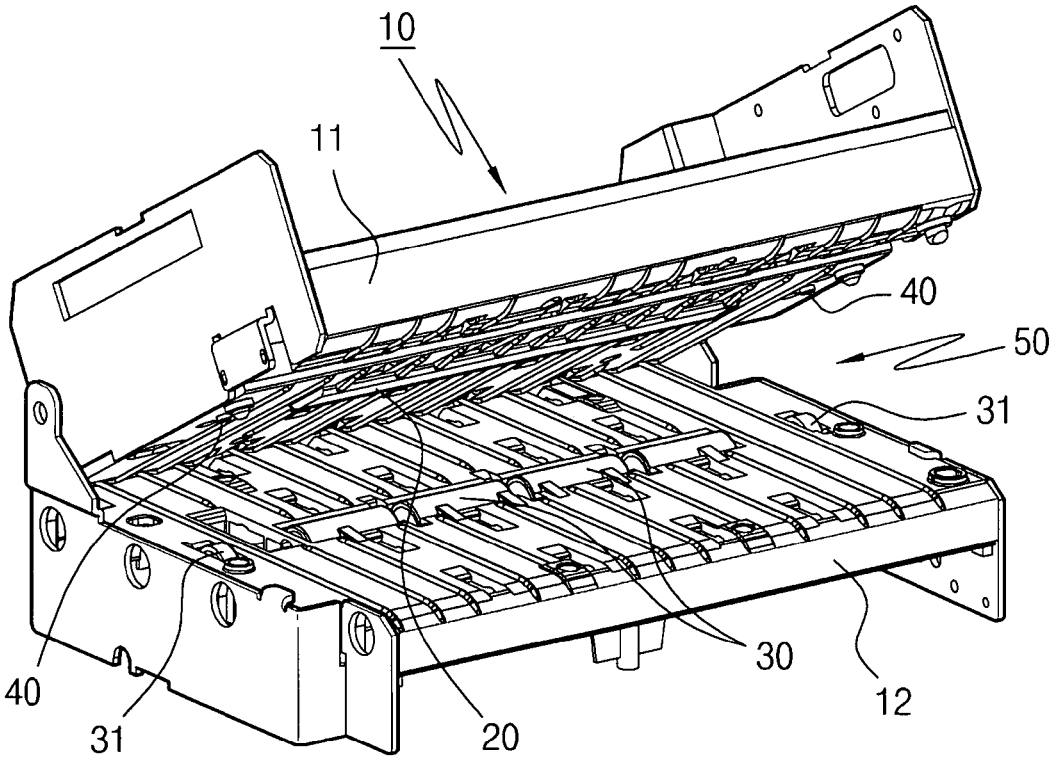
FIG. 3 is a perspective view of a structure for adjusting a gap between a paper money discriminating sensor and paper money feed rollers in a paper money discriminating apparatus according to an embodiment of the invention.
Figure 4:
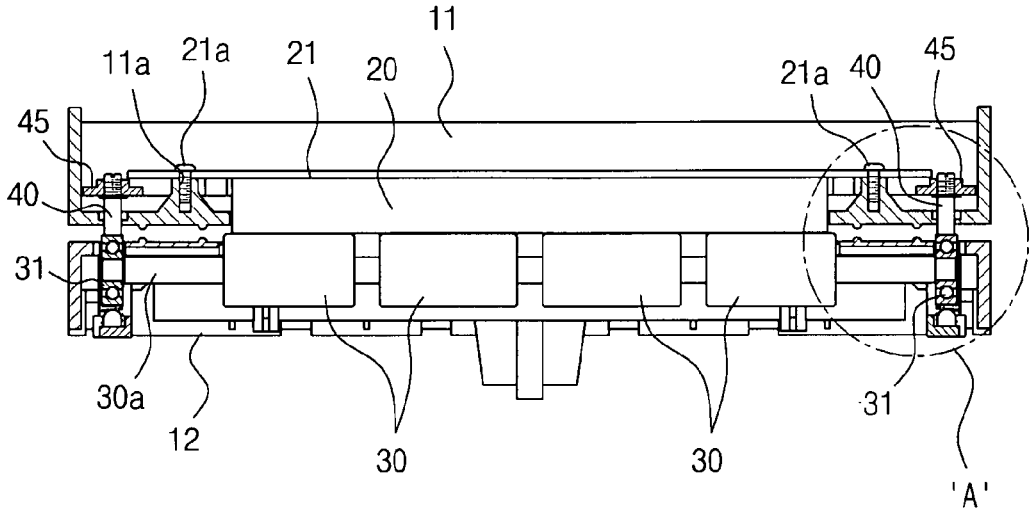
FIG. 4 is a front cross-sectional view of the structure for adjusting the gap in the paper money discriminating apparatus according to the embodiment of the invention.
Figure 5:
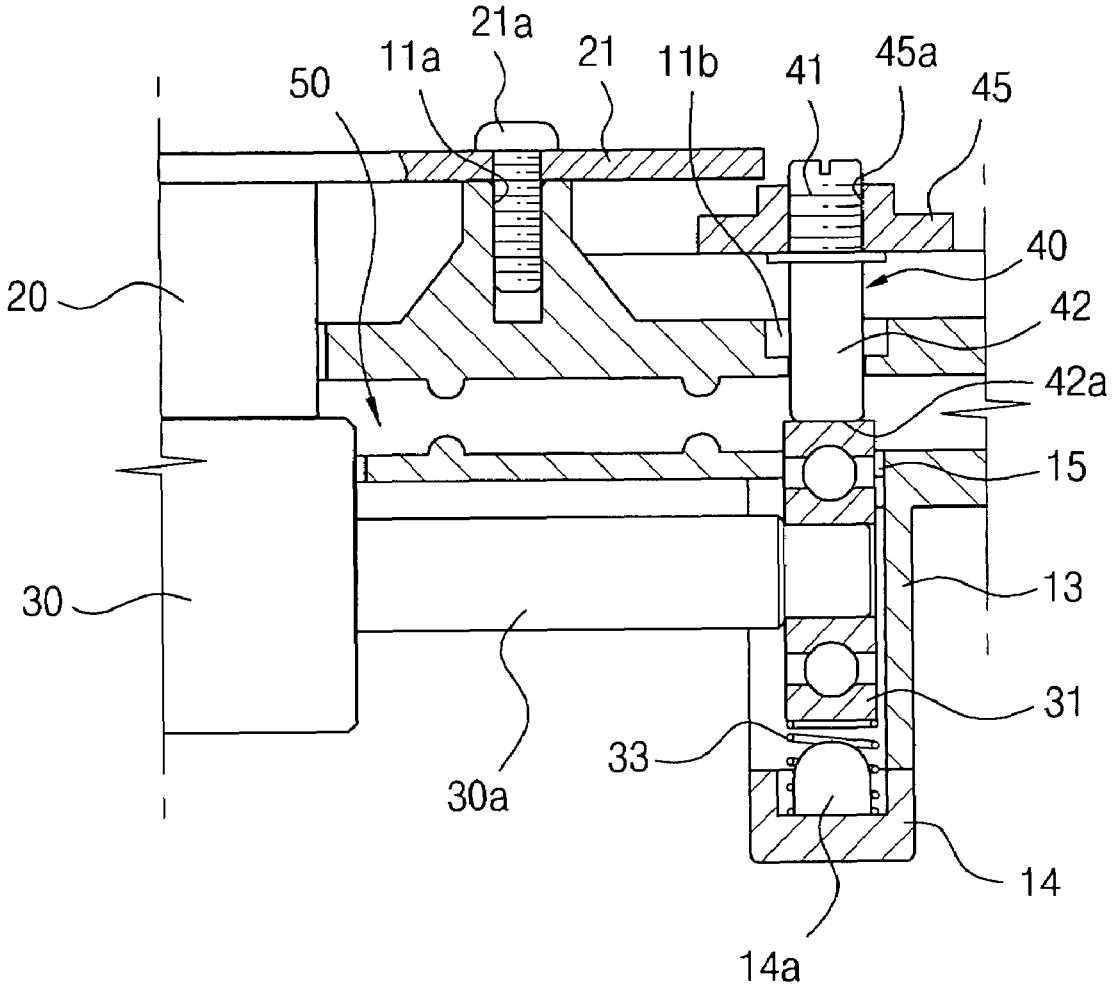
FIG. 5 is a detailed view of a portion "A" of FIG. 4.
Figure 6:
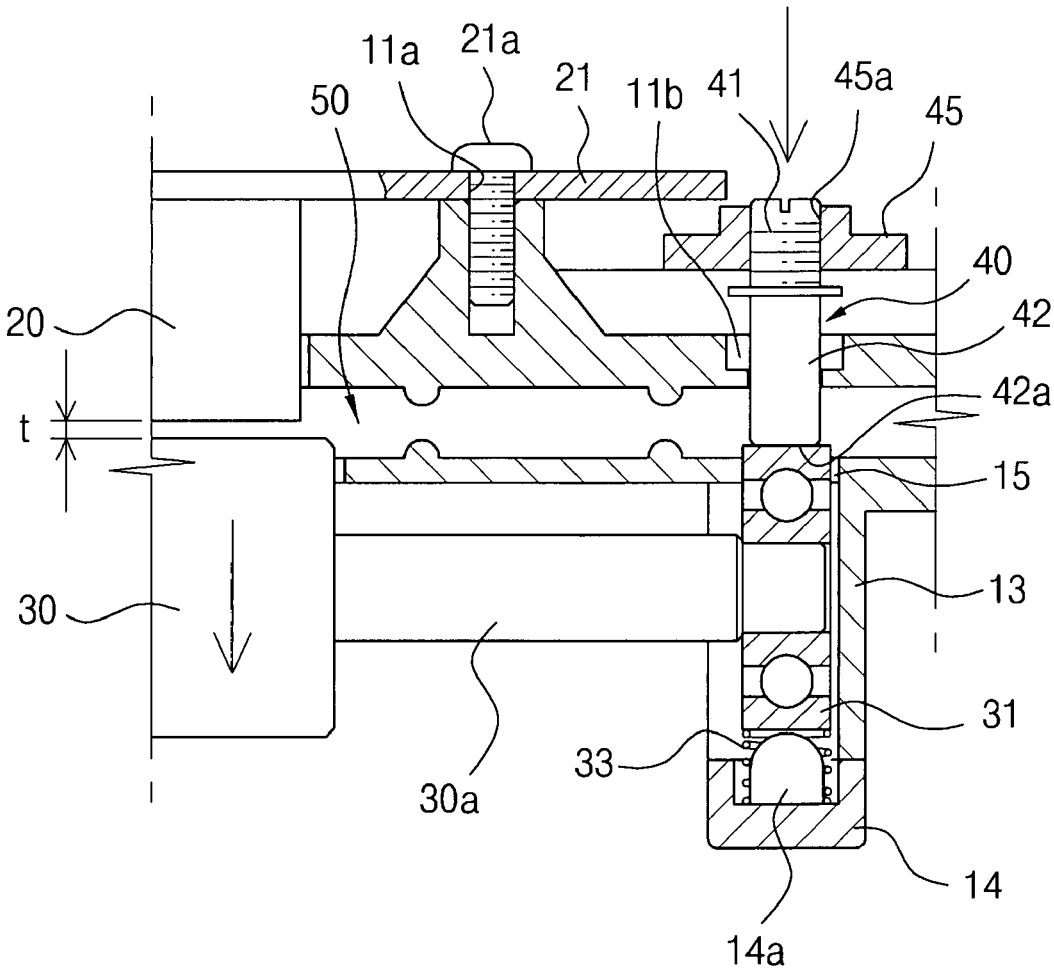
FIG. 6 is a side view showing that the gap in the paper money discriminating apparatus according to the embodiment of the invention is adjusted.

FIG. 3 is a perspective view of a structure for adjusting a gap between a paper money discriminating sensor and paper money feed rollers in a paper money discriminating apparatus according to an embodiment of the invention. FIG. 4 is a front cross-sectional view of the structure for adjusting the gap in the paper money discriminating apparatus according to the embodiment of the invention. FIG. 5 is a detailed view of a portion "A" of FIG. 4. FIG. 6 is a side view showing that the gap in the paper money discriminating apparatus according to the embodiment of the invention is adjusted.

Referring to FIGS. 3 to 5, the structure for adjusting a gap between a paper money discriminating sensor and paper money feed rollers according to the embodiment of the invention includes a paper money discriminating sensor 20, paper money feed rollers 30, and gap adjusters 40. The paper money discriminating sensor 20 is provided in an upper body 11 of a paper money discriminating apparatus 10 and discriminates whether paper money to be conveyed along a conveyance path 50 is counterfeit money. The paper money feed rollers 30 are rotatably provided in a lower body 12 facing the paper money discriminating sensor 20 and are spaced from each other at a predetermined interval. The gap adjusters 40 are provided between the paper money discriminating sensor 20 and the paper money feed rollers 30, and adjust a gap between the sensor and the rollers.

The paper money discriminating sensor 20 is fixed to a lower surface of a fixing bracket 21. Further, both ends of the fixing bracket 21 are fixed to the upper body 11 by bolts 21*a* that are to be fastened into fastening holes 11*a* formed in the upper body.

Bearings 31 are provided at both ends of a rotating shaft 30*a* of the paper money feed rollers 30. Each of the bearings 31 is inserted into a bearing hole 15 of each of the bearing seats 13 that are formed in the lower body 12 at both sides of the lower body. Further, the paper money feed rollers 30 are spaced from the paper money discriminating sensor 20, which is provided in the upper body 11, by a predetermined distance so as to face the paper money discriminating sensor.

The paper money discriminating sensor 20 may be formed of a magnetic sensor, which senses magnetic ingredients of paper money to discriminate whether paper money to be conveyed along a conveyance path 50 is counterfeit money. When a gap between the magnetic sensor and the paper money feed rollers 30 is in the range of, for example, 0.1 to 0.2 mm, the magnetic sensor has the best sensitivity.

Accordingly, the gap adjusters 40, which are provided between the paper money discriminating sensor 20 and the paper money feed rollers 30, are used as a unit that adjusts to maintain a constant gap (t=0.1 to 0.2 mm) between the paper money discriminating sensor 20 and the paper money feed rollers 30.

The gap adjusters 40 each have a thread 41 at upper portions thereof, and each have a pressing portion 42 at lower portions thereof.

The portions of the gap adjusters 40 having the threads 41 are fastened into threaded holes 45*a* of supporting brackets 45 that are provided at both ends of the paper money discriminating sensor 20. In this case, if rotating in a clockwise or counterclockwise direction, each of the gap adjusters 40 moves up and down through a through hole 11*b* by a predetermined distance.

Each of the bearings 31 comes in contact with a lower end 42*a* of each gap adjuster 40 at an upper portion thereof. Further, each of the bearings 31 comes in contact with a supporting spring 33 at a lower portion thereof, so that an elastic force is applied to the bearing.

In this case, the supporting spring 33 is formed of a coil spring. A protrusion 14*a* of a lower cap 14, which is fixed to the lower portion of each bearing seat 13, is inserted into the supporting spring 33. Accordingly, the supporting spring 33 presses upward the lower portion of each bearing 31.

Referring to FIG. 6, if the gap adjusters 40 rotate in a clockwise direction in order to adequately adjust the gap (t) between the paper money discriminating sensor 20 and the paper money feed rollers 30, the gap adjusters 40 descend and press the bearings 31 coming in contact with the lower ends 42*a* of the gap adjusters 40. Therefore, the paper money feed rollers fixed to the rotating shaft 30*a* are pressed and descend.

In contrast, if the gap adjusters 40 rotate in a counterclockwise direction, the gap adjusters 40 ascend and the bearings 31 ascend due to an elastic force of the supporting springs 33 provided under the bearings 31. Accordingly, the gap (t) becomes smaller.

As described above, the gap adjusters 40 rotate in a clockwise or counterclockwise direction to adjust the height of the paper money feed rollers 30. Therefore, it is possible to adequately adjust the gap (t=0.1 to 0.2 mm) between the paper money discriminating sensor 20 and the paper money feed rollers 30.

Figure 7:
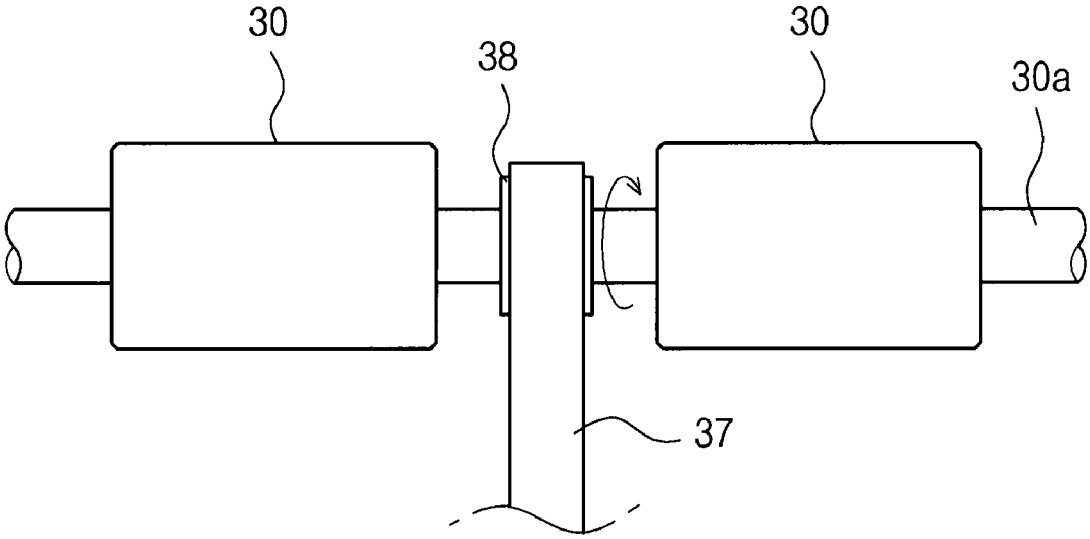
FIG. 7 is a view showing the paper money discriminating apparatus according to another embodiment of the invention.

FIG. 7 is a view showing the paper money discriminating apparatus according to another embodiment of the invention.

Referring to FIG. 7, a belt 37 that rotates using power transmitted from a motor (not shown) is connected to a pulley 38 fixed to the rotating shaft 30*a* of the paper money feed rollers 30, so as to rotate the paper money feed rollers 30 at a predetermined speed in a direction where the paper money is conveyed.

In this case, paper money can pass through the gap, which is formed between the paper money discriminating sensor 20 and the paper money feed rollers 30 of the paper money discriminating apparatus 10, without resistance caused by friction.

Although the invention has been described in connection with the exemplary embodiments of the invention, it will be apparent to those skilled in the art that various modifications and changes may be made thereto without departing from the scope and spirit of the invention.

As described in detail above, in the structure for adjusting a gap in a paper money discriminating apparatus according to the embodiment of the invention, it is possible to adequately adjust a gap between a paper money discriminating sensor (which is provided in an ATM and discriminates whether paper money to be conveyed along a conveyance path is counterfeit money) and paper money feed rollers.

What is claimed is:

1. A structure for adjusting a gap of a paper money discriminating apparatus that includes a lower body and an upper body to rotate upward about a hinge shaft to open a conveyance path, the structure comprising:

a paper money discriminating sensor that is provided in the upper body and discriminates whether a paper money to be conveyed along the conveyance path is counterfeit money;

paper money feed rollers that are rotatably provided in the lower body facing the paper money discriminating sensor and are spaced from each other at a predetermined interval; and gap adjusters that are provided in the upper body and variably adjust a gap between the paper money discriminating sensor and the paper money feed roller by moving a shaft to which the paper money feed roller is fixed, wherein the gap adjusters each have a thread at upper portions thereof, and each have a pressing portion at lower portions thereof, and the portions of the gap adjusters having the threads are fastened into threaded holes of supporting brackets that are provided at both end portions of the paper money discriminating sensor, so that if rotating in a clockwise or counterclockwise direction, each of the gap adjusters moves up and down through the threaded holes by a predetermined distance.

2. The structure according to claim 1, wherein bearings are provided at an ends of the shaft, and each of the bearings is rotatably inserted into a hole of each of bearing seats that are formed at both sides of the lower body.

3. The structure according to claim 2, wherein each of the bearings comes in contact with a lower end of each gap adjuster at an upper portion thereof, and each of the bearings comes in contact with a supporting spring at a lower portion thereof, so that an elastic force is applied to the bearing.

4. The structure according to claim 1, wherein the paper money feed rollers are connected to a belt that rotates using power transmitted from a motor, and rotate at a predetermined speed in a direction where the paper money is conveyed.

5. An apparatus for discriminating a paper money, the apparatus comprising:

a lower body and an upper body forming a conveyance path therebetween;

a paper money discriminating sensor provided in the upper body and discriminating whether a paper money conveyed along the conveyance path is counterfeit money;

a paper money feed roller rotatably provided in the lower body and facing the paper money discriminating sensor; and gap adjusters that are provided in the upper body and variably adjust a gap between the paper money discriminating sensor and the paper money feed roller by moving a shaft to which the paper money feed roller is fixed, wherein the gap adjusters each have a thread at upper portions thereof, and each have a pressing portion at lower portions thereof, and the portions of the gap adjusters having the threads are fastened into threaded holes of supporting brackets that are provided at both end portions of the paper money discriminating sensor, so that if rotating in a clockwise or counterclockwise direction, each of the gap adjusters moves up and down through the threaded holes by a predetermined distance.

6. The apparatus according to claim 5, further comprising:

a bearing provided at an end of the shaft, wherein the gap adjuster contacts the bearing.

* * * * *